US011475734B2

(12) United States Patent
You et al.

(10) Patent No.: US 11,475,734 B2
(45) Date of Patent: Oct. 18, 2022

(54) GAMING SYSTEMS AND METHODS FOR DYNAMIC JACKPOT ADMINISTRATION

(71) Applicant: SG Gaming, Inc., Las Vegas, NV (US)

(72) Inventors: Qin You, Randwick (AU); Damien James Greig, Oliveira (MO); Shumin Lan, North Rocks (AU); Peter Wilkins, Curl Curl (AU); Yanhua Yin, Newington (AU)

(73) Assignee: SG Gaming, Inc., Las Vegas, NV (US)

( * ) Notice: Subject to any disclaimer, the term of this patent is extended or adjusted under 35 U.S.C. 154(b) by 66 days.

(21) Appl. No.: 17/062,946

(22) Filed: Oct. 5, 2020

(65) Prior Publication Data

US 2021/0104125 A1 Apr. 8, 2021

Related U.S. Application Data

(60) Provisional application No. 62/911,599, filed on Oct. 7, 2019.

(51) Int. Cl.
*G07F 17/32* (2006.01)

(52) U.S. Cl.
CPC ..... *G07F 17/3258* (2013.01); *G07F 17/3216* (2013.01)

(58) Field of Classification Search
CPC ..... G07F 17/3258; G07F 17/3216
See application file for complete search history.

(56) References Cited

U.S. PATENT DOCUMENTS

| | | | | |
|---|---|---|---|---|
| 6,110,043 | A | 8/2000 | Olsen | |
| 6,358,149 | B1 | 3/2002 | Schneider et al. | |
| 7,530,896 | B2 | 5/2009 | Gauselmann | |
| 8,147,324 | B2 | 4/2012 | Mothwurf et al. | |
| 8,251,805 | B2 | 8/2012 | Englman et al. | |
| 8,257,169 | B2 | 9/2012 | Englman | |
| 8,267,777 | B2 | 9/2012 | Jaffe | |
| 8,550,904 | B2 | 10/2013 | Kyte et al. | |
| 8,821,265 | B2 | 9/2014 | Englman et al. | |
| 9,483,899 | B2 | 11/2016 | Englman | |
| 10,297,111 | B2 | 5/2019 | Czubak | |
| 2006/0052161 | A1* | 3/2006 | Soukup | G07F 17/32 463/27 |
| 2015/0024836 | A1 | 1/2015 | Wright et al. | |
| 2016/0086448 | A1* | 3/2016 | Aoki | G07F 17/326 463/27 |

* cited by examiner

*Primary Examiner* — David L Lewis
*Assistant Examiner* — Robert E Mosser

(57) ABSTRACT

A gaming system includes a gaming machine for playing at least one casino wagering game, one or more electronic display devices, and game-logic circuitry. The game-logic circuitry directs at least one of the display devices to display a progressive jackpot, detects, via at least one electronic input device of the gaming machine, a physical item associated with a monetary value that establishes a credit balance, increments the progressive jackpot in response to play of the casino wagering game, directs at least one of the electronic display devices to display an outcome resulting from the casino wagering game, awards the progressive jackpot in response to the displayed outcome being a progressive-winning outcome and/or in response to the progressive jackpot being incremented to a triggering amount, and receives, via at least one of the electronic input devices, a cashout input that initiates a payout from the credit balance.

22 Claims, 5 Drawing Sheets

GAMING SYSTEMS AND METHODS FOR DYNAMIC JACKPOT ADMINISTRATION

CROSS REFERENCE TO RELATED APPLICATIONS

This application claims the benefit of priority to U.S. Provisional Application No. 62/911,599, filed Oct. 7, 2019, the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2019, Scientific Games International, Inc.

FIELD OF THE DISCLOSURE

The present disclosure relates generally to gaming systems, apparatus, and methods and, more particularly, to dynamic jackpot administration.

BACKGROUND

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from playing the game at their desired pace.

As the industry matures, the creativity and ingenuity required to improve such operation of gaming apparatus and games grows accordingly.

SUMMARY

According to one aspect of the present disclosure, a gaming system comprises a regulated gaming machine primarily dedicated to playing at least one casino wagering game, one or more electronic display devices, and game-logic circuitry. The gaming machine includes one or more electronic input devices. The game-logic circuitry directs at least one of the display devices to display a progressive jackpot, detects, via at least one of the electronic input devices, a physical item associated with a monetary value that establishes a credit balance, increments the progressive jackpot in response to play of the casino wagering game, directs at least one of the electronic display devices to display an outcome resulting from the play of the casino wagering game, in response to the displayed outcome being a progressive-winning outcome, awards the progressive jackpot, in response to the progressive jackpot being incremented to a triggering amount, awards the progressive jackpot, and receives, via at least one of the electronic input devices, a cashout input that initiates a payout from the credit balance. The gaming system may be incorporated into a single, freestanding gaming machine.

According to another aspect of the present disclosure, a method for conducting at least one casino wagering game using a gaming system including a regulated gaming machine primarily dedicated to playing the at least one casino wagering game, one or more electronic display devices, and game-logic circuitry is provided. The method includes directing, by the game-logic circuitry, at least one of the one or more display devices to display a progressive jackpot, detecting, via at least one of one or more electronic input devices of the regulated gaming machine, a physical item associated with a monetary value that establishes a credit balance, incrementing, by the game-logic circuitry, the progressive jackpot in response to play of the casino wagering game, directing, by the game-logic circuitry, at least one of the one or more electronic display devices to display an outcome resulting from the play of the casino wagering game, in response to the displayed outcome being a progressive-winning outcome, awarding, by the game-logic circuitry, the progressive jackpot, in response to the progressive jackpot being incremented to a triggering amount, awarding, by the game-logic circuitry, the progressive jackpot, and receiving, via at least one of the electronic input devices, a cashout input that initiates a payout from the credit balance.

According to yet another aspect of the present disclosure, a regulated gaming machine primarily dedicated to playing at least one casino wagering game is provided. The gaming machine includes one or more electronic input devices, one or more electronic display devices, and game-logic circuitry. The game-logic circuitry is configured to direct at least one of the display devices to display a progressive jackpot, detect, via at least one of the electronic input devices, a physical item associated with a monetary value that establishes a credit balance, increment the progressive jackpot in response to play of the casino wagering game, direct at least one of the electronic display devices to display an outcome resulting from the play of the casino wagering game, in response to the displayed outcome being a progressive-winning outcome, award the progressive jackpot, in response to the progressive jackpot being incremented to a triggering amount, award the progressive jackpot, and receive, via at least one of the electronic input devices, a cashout input that initiates a payout from the credit balance.

Additional aspects of the invention will be apparent to those of ordinary skill in the art in view of the detailed description of various embodiments, which is made with reference to the drawings, a brief description of which is provided below.

Figure 1:
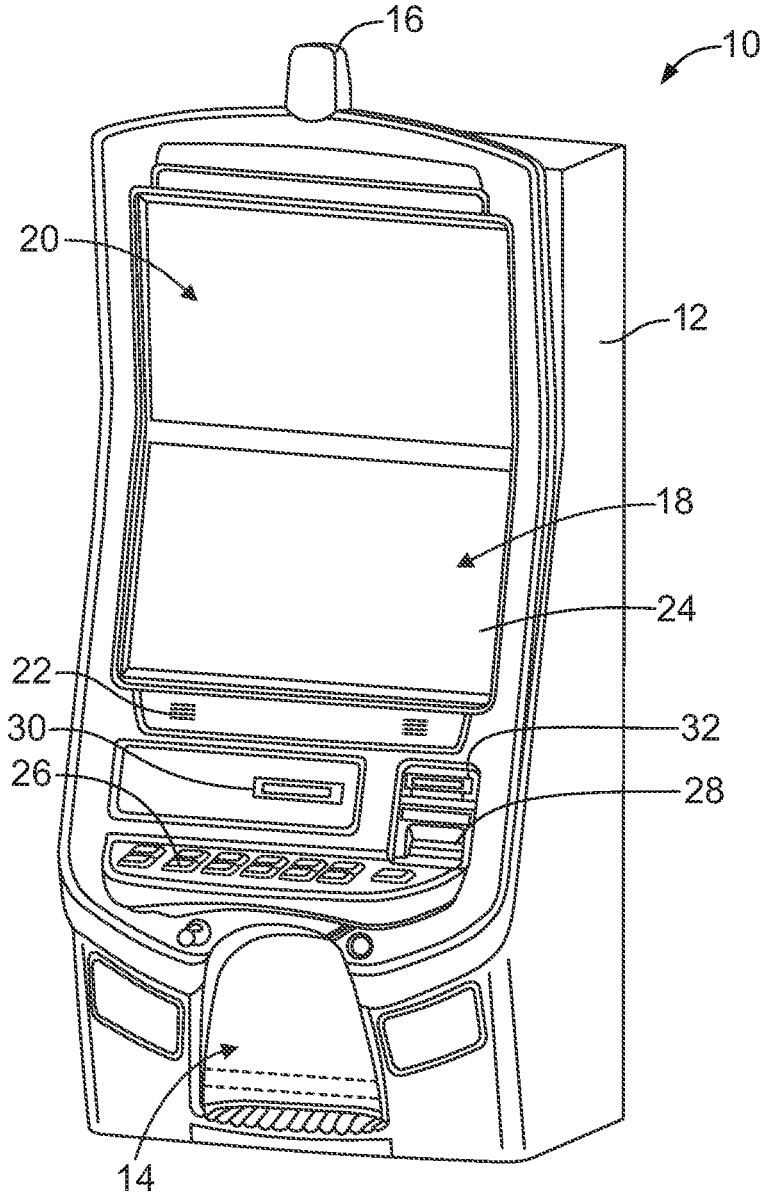
FIG. 1 is a perspective view of a free-standing gaming machine according to an embodiment of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

The systems and methods described herein facilitate administration of a progressive jackpot that, depending upon the conditions of the associated wagering games and/or the conditions of the progressive jackpot itself, can be dynamically awarded to one or more players. For example, the progressive jackpot may be restricted to a certain level of funding (e.g., for regulatory purposes, operator preference, system limitations, etc.) that may be reached if no progressive-winning outcome is detected from play of one or more wagering games. As a result, subsequent wagers by players may not increase the available progressive jackpot, and players may be disinterested in further play of the wagering games as a result. Accordingly, the systems and methods described herein facilitate additional and/or alternative trigger conditions for awarding the progressive jackpot that are calibrated to the restrictions or limitations of the progressive jackpot. For example, the systems and methods described herein may establish a triggering amount that, in response to the progressive jackpot being incremented to the triggering amount, causes the progressive jackpot to be awarded to one or more players, thereby "resetting" the jackpot to avoid maintaining the maximum amount of funding of the progressive jackpot.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
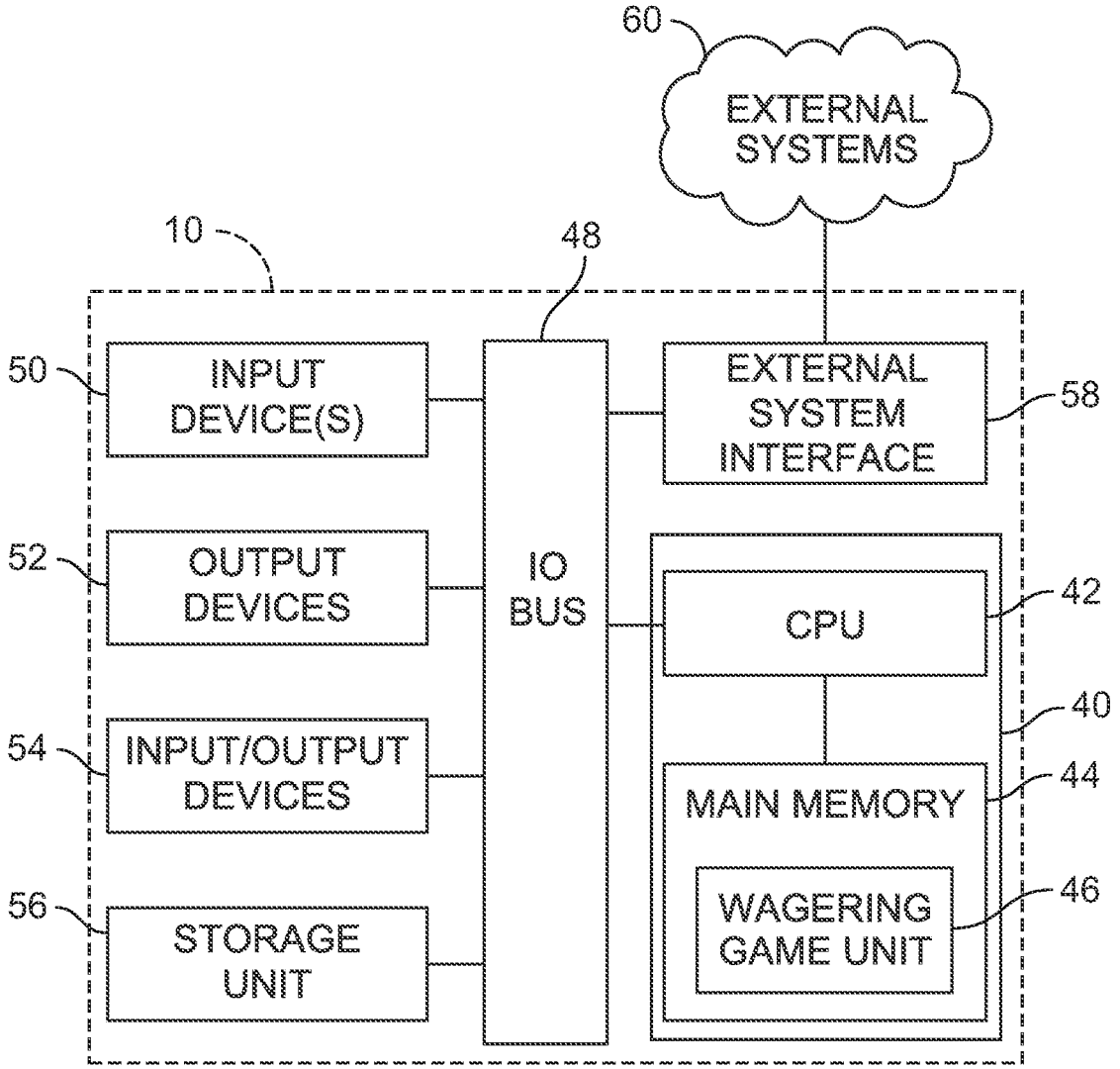
FIG. 2 is a schematic view of a gaming system according to an embodiment of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMID. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
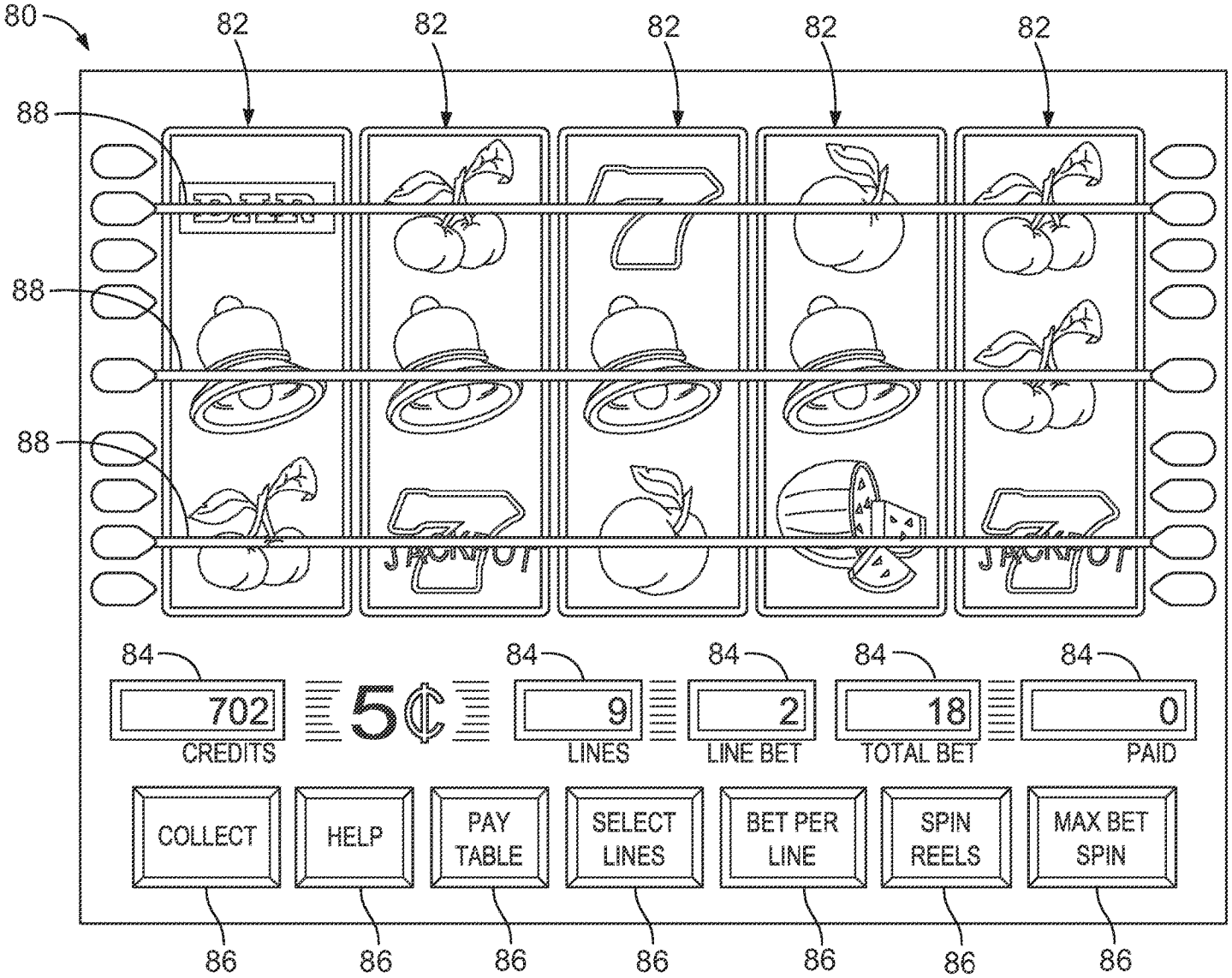
FIG. 3 is an image of an exemplary basic-game screen of a wagering game displayed on a gaming machine, according to an embodiment of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
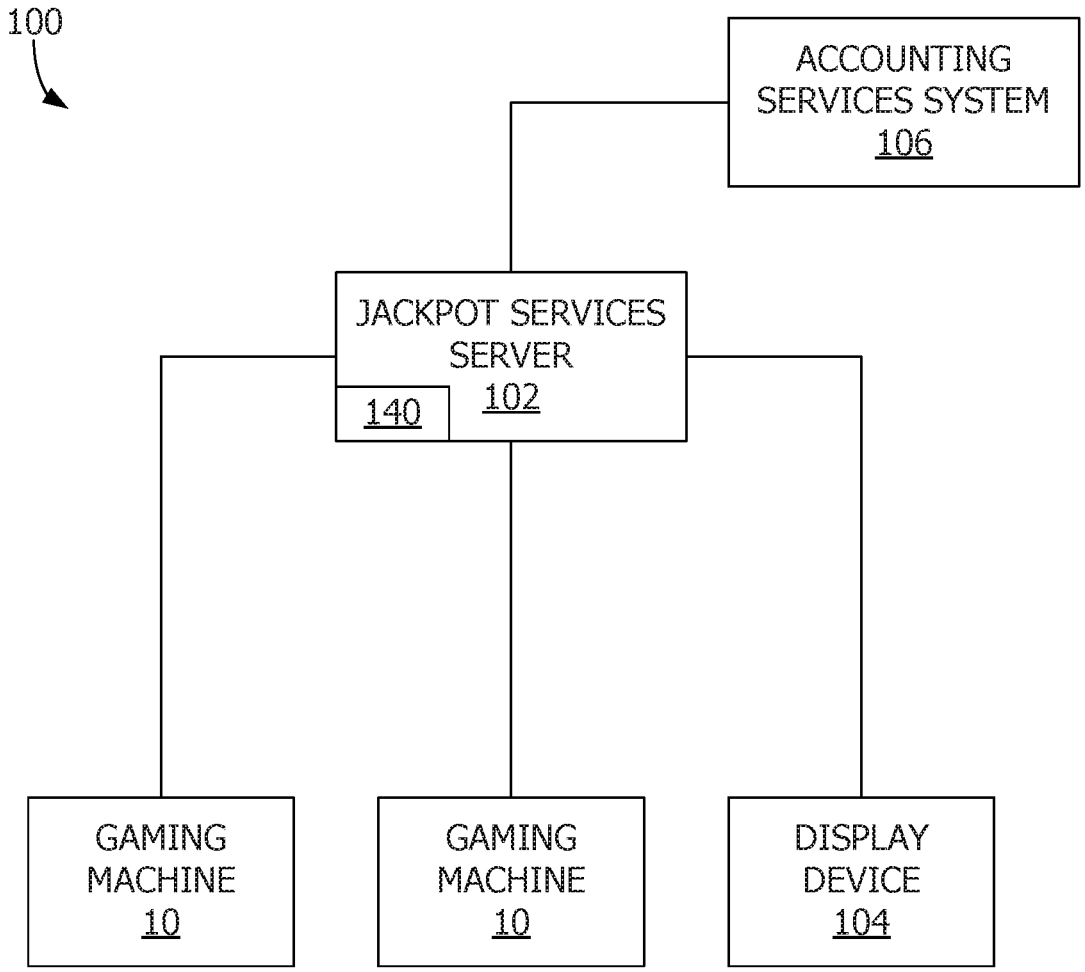
FIG. 4 is a block diagram of an example gaming system in accord with at least some aspects of the disclosed concepts.

FIG. 4 is a block diagram of an example gaming system 100 for administering a dynamic jackpot. The gaming system 100 includes one or more gaming machines 10 and a jackpot services server 102. In other embodiments, the system 100 may include additional, fewer, or alternative devices, including those described elsewhere herein.

The jackpot services server 102 is communicatively coupled to one or more gaming machines 10 for administering one or more jackpots for wagering games conducted at (or presented at, for thin client gaming machines 10) the gaming machines 10. The jackpot services server 102 may be a single device or a distributed system (i.e., a plurality of communicatively coupled devices that perform the functionality described herein). In embodiments in which the jackpot services server 102 is distributed, the jackpot services server 102 may not be a centralized system, but rather distributed among the gaming machines 10. In such embodiments, the jackpot services server 102 may be incorporated into one or more gaming machines 10.

The jackpot services server 102 may include game-logic circuitry 140 similar to the game-logic circuitry 40 shown in FIG. 2. In certain embodiments, the game-logic circuitry 140 may be different from the game-logic circuitry 40 to perform functions that may not be performed by the gaming machines 10 (or remove components for functions performed by the gaming machines 10 that may not be performed by the jackpot services server 102, such as credit input devices). In some embodiments, the jackpot services server 102 may be configured to operate with thin-client gaming machines 10 such that the jackpot services server 102 is configured to conduct casino wagering games to be presented at the gaming machines 10. For example, the jackpot services server 102 may be communicatively coupled to one or more display devices 104 separate from a gaming machine 10 for play of a wagering game and participation in the jackpot service provided by the jackpot services server 102. In this example, the display device 104 may rely upon the game-logic circuitry 140 or another suitable logic circuitry to perform the functionality to cause the display device 104 to present the wagering game. Although the display device 104 is shown as separate from the jackpot services server 102, it is to be understood that the display device 104 may be integrated with the jackpot services server 102 in at least some embodiments.

The jackpot services server 102 is configured to manage one or more progressive jackpots associated with the gaming machines 10. More specifically, the jackpot services server 102 monitors the funding of the progressive jackpots and administers jackpot awards to winning players at the gaming machines 10 in response to trigger conditions associated with the jackpot awards. An example trigger condition may include, for example, a certain combination of symbols displayed on a symbol array similar to the array shown in FIG. 3. The use of the jackpot services server 102 to manage jackpots rather than the gaming machines 10 managing respective jackpots enables the system 100 to provide a single jackpot to multiple gaming machines 10, thereby increasing the funding of the jackpot and the associated jackpot awards.

To fund the jackpots, the jackpot services server 102 is configured accumulate portions of wagers placed at the connected gaming machines 10. That is, when a wager is placed at one of the gaming machines 10, the wager amount may be divided to fund various game features and/or other aspects of the gaming environment. For example, a wager amount may be divided into portions that include a first portion for funding awards for the base wagering game, a second portion for incrementing the progressive jackpot, and a third portion for funding a reseed amount of the progressive jackpot. The reseed amount is applied to a jackpot when the jackpot has been depleted due to one or more jackpot awards, thereby ensuring the jackpot awards exceed a certain amount that reflects the limited availability and excitement of the jackpot awards. In certain embodiments, the funding of jackpots may not be limited to wagers, but may also accrue funds from one or more other sources.

To monitor the funding of the jackpots, the jackpot services server 102 may be notified by the gaming machines 10 in response to one or more wagers placed at the gaming machines 10. The gaming machines 10 may notify the jackpot services server 102 of the amount of the one or more portions of the wagers, or the jackpot services server 102 may be notified of the wager amount and may distribute the wager amount to the associated subsystems. In other embodiments, the jackpot services server 102 may be notified via an accounting services system 106. The accounting services system 106 may be communicatively coupled to the gaming machines 10 and/or the jackpot services server 102 to manage incoming and outgoing funds for a gaming environment. For example, the accounting services system 106 may receive and distribute the funds from wagers to various subsystems (such as the gaming system 100) within one or more gaming environments. The gaming machines 10 may notify the accounting services system 106 of received wagers, and the accounting services system 106 may allocate funds from the wagers to the jackpot services system 102.

The jackpot awards may be awarded in response to trigger conditions as described herein. Similar to the funding of the wagers, the gaming machines 10 may notify the jackpot services server 102 if a trigger condition has occurred to cause the jackpot services server 102 to allocate at least a portion of the associated jackpot to the jackpot award. In some embodiments, at least some trigger conditions may be detected by the jackpot services server 102 rather than the gaming machines 10, such as trigger conditions related to an amount of the jackpot. To confirm the jackpot award, the jackpot services server 102 may notify at least the gaming machine 10 associated with the jackpot award and/or the accounting services system 106. If the accounting services system 106 is notified, the account services system 106 may deallocated the awarded amount from the jackpot and reallocate the awarded amount to the player via a credit balance, electronic wallet, or other suitable forms of receiving and storing funds associated with a player.

The trigger conditions associated with jackpot awards may be related to play of a base or bonus game feature of a casino wagering game conducted at the gaming machines 10. That is, an event, combination of events, and/or a state of the base or bonus game may result in a jackpot award. For example, a certain symbol or combination of symbols within the base or bonus game conducted at the gaming machine 10 may result in a jackpot award. The trigger conditions may be selected or configured to impose a rarity to the trigger conditions for the jackpot awards in comparison to awards occurring within the wagering game. That is, the value of the jackpot awards, if awarded too frequently, may skew the payback percentage (i.e., a percentage of a wager that the player, on average, will receive from awards) to be unfavorable to the operator. As a result, the probability of achieving the trigger conditions of the jackpot awards may be relatively low.

The rarity of achieving the trigger conditions and the associated progressive jackpot award may be enticing to at least some players to play the casino wagering game at the gaming machines 10. However, if the rarity of the trigger conditions is too low, then the players may become disinterested in the casino wagering game due to the lack of jackpot awards. In addition, in some embodiments, the progressive jackpot may have a predetermined upper limit amount. That is, when the predetermined upper limit amount is reached, the jackpot is not incremented through subsequent wagers. As a result, the players may not feel like their current play of the casino wagering game is contributing to the available progressive jackpot if the upper limit amount has been reached, thereby potentially resulting in disinterest in further play of the game. Accordingly, the system 100 is configured to provide dynamic progressive jackpot administration by including additional and/or alternative triggers to award the progressive jackpot.

Figure 5:
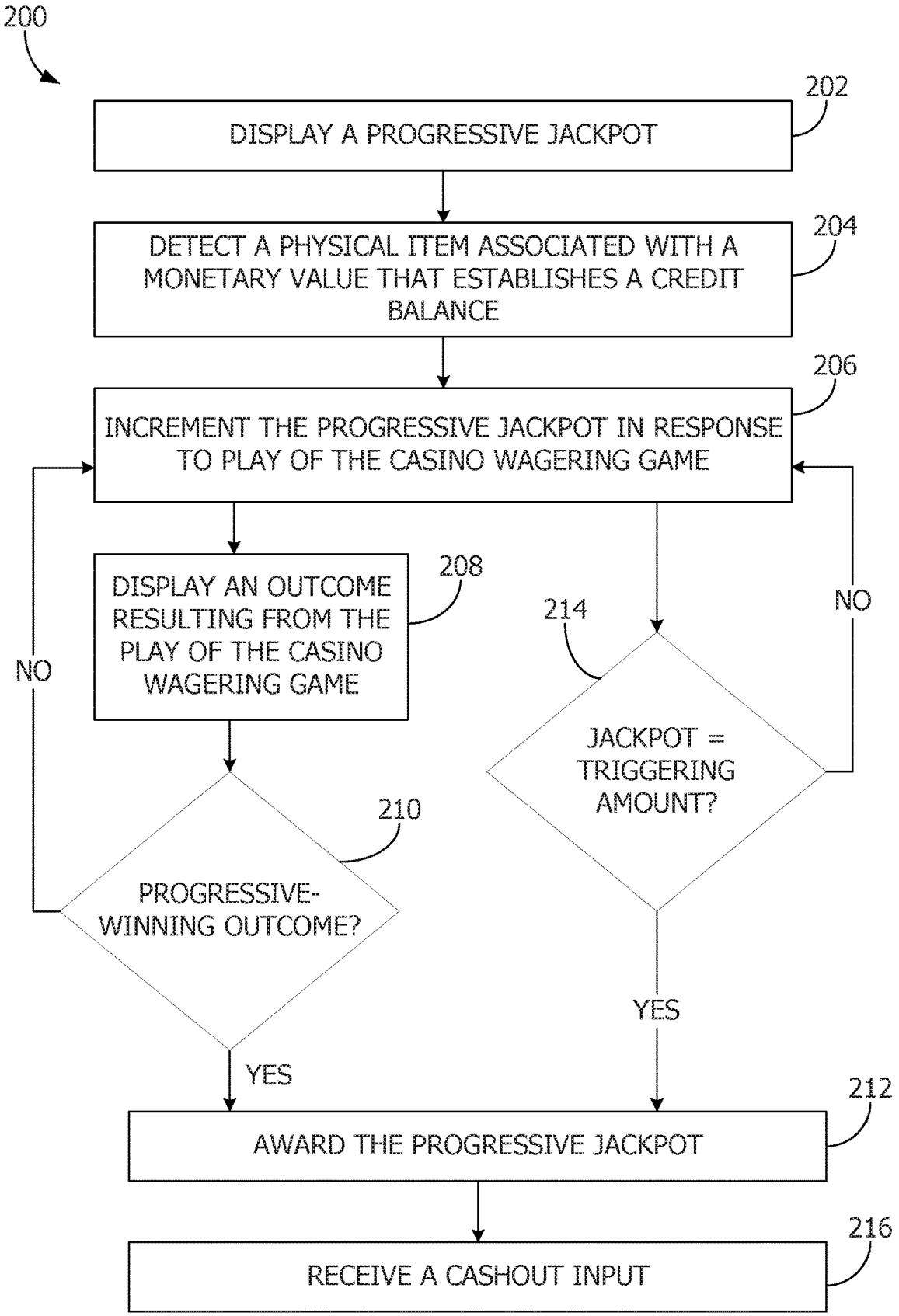
FIG. 5 is a flow diagram of an example method for administering a dynamic jackpot in accord with at least some aspects of the disclosed concepts.

FIG. 5 is a flow diagram of an example method 200 for administering a progressive jackpot using the system 100 (shown in FIG. 4). The method 200 is at least partially performed by the game-logic circuitry 140 of the jackpot services server 102. In at least some embodiments, additional and/or alternative devices may perform the steps of the method 200, such as the game-logic circuitry 40 of the gaming machine 10 (both shown in FIG. 2). In other embodiments, the method 200 may include additional, fewer, or alternative steps, including those described elsewhere herein.

In the example embodiment, with respect to FIGS. 4 and 5, the game-logic circuitry 140 causes one or more display devices (e.g., displays 18, 20 shown in FIG. 1 and display device 104 shown in FIG. 4) to display 202 a progressive jackpot. The progressive jackpot has an award amount that is monitored by the players via the display devices such that the players may track the current jackpot amount within the progressive jackpot. The progressive jackpot may be managed by the jackpot services server 102 such that the jackpot services server 102 is configured to send updates on the jackpot amounts to the display devices.

In the example embodiment, to participate in a casino wagering game associated with the progressive jackpot, a player may provide funds to a gaming machine 10 to establish a credit balance for funding wagers placed during the casino wagering game. More specifically, the game-logic circuitry 40 of a respective gaming machine 10 may detect 204, via one or more electronic input devices (e.g., bill acceptor, card reader, ticket reader, coin acceptor, etc.), a physical item associated with a monetary value that establishes a credit balance associated with the player. During play of the casino wagering game, wagers may be deducted from the credit balance while awards may be added to the credit balance.

During play of the casino wagering game, the game-logic circuitry 140 and/or the game-logic circuitry 40 of the gaming machine 10 may increment 206 the progressive jackpot in response to play of the casino wagering game. In the example embodiment, the progressive jackpot is incremented in response to wagers placed by the player to play the casino wagering game. In certain embodiments, other actions and/or events may cause the game-logic circuitry 140 to increment 206 the progressive jackpot. The game-logic circuitry 140 may increment 206 the progressive jackpot in response to one or more notifications from one or more gaming machines 10 indicating that one or more wagers have been placed to enable the game-logic circuitry 140 to increment 206 the progressive jackpot at least partially as a function of the placed wagers.

The game-logic circuitry 40 of the gaming machine 10 and/or the game-logic circuitry 140 of the jackpot services server 102 cause one or more display devices to display 208 an outcome resulting from play of the casino wagering game. The outcome may be determined at least partially as a function of one or more random numbers generated by a random number generator of the game-logic circuitry 40, 140. In one example, the casino wagering game includes a symbol array that is populated by symbols (similar to the wagering game shown in FIG. 3) to form an outcome. The outcome may be associated with one or more awards that may be provided to the player, including a jackpot award. That is, the outcome may include one or more trigger conditions (e.g., a combination of symbols) that are associated with an award. For a symbol-based game using a symbol array, the awards may be based on the presence of one or more symbols, combinations of symbols, and/or sequences of symbols within the symbol array during the outcome. Each "winning outcome" may include a respective award, and at least one winning outcome is associated with a jackpot award from the progressive jackpot. The game-logic circuitry 40 or the game-logic circuitry 140 may determine 210 whether or not the outcome is or matches a progressive-winning outcome associated with the progressive jackpot. If the outcome is determined 210 to be a progressive-winning outcome, the game-logic circuitry 40 or the game-logic circuitry 140 awards 212 the progressive jackpot to the player associated with the progressive-winning outcome. It is to be understood that awarding the progressive jackpot may include awarding the entire jackpot amount and/or awarding a portion of the jackpot amount. For example, multiple progressive-winning outcomes may be available, where one progressive-winning outcome awards the progressive jackpot in its entirety and another progressive-winning outcome (with a relatively greater probability of achieving) may award a portion of the progressive jackpot.

The outcomes may be transmitted to the game-logic circuitry 140 for determination 210, or the game-logic circuitry 40 of each gaming machine 10 may perform the determination 210 separately and notify the jackpot services server 102 if the progressive-winning outcome is detected. The game-logic circuitry 140 may be configured to notify the accounting services system 106 in response to awarding 212 the progressive jackpot to a player to cause the accounting services system 106 to allocate the progressive jackpot to the player and allocate the reseed funds to the jackpot services server 102 for the subsequent progressive jackpot. If no progressive-winning outcome is detected, the progressive jackpot may continue to be incremented 206 during play of the casino wagering game.

The game-logic circuitry 140 may also monitor the progressive jackpot to determine 1214 whether or not the progressive jackpot has been incremented to a triggering amount. The triggering amount is a value at which the progressive jackpot may be automatically awarded to one or more players participating in casino wagering games associated with the bonus jackpot. Awarding a jackpot award based on the triggering amount may prevent the progressive jackpot from maintaining maximum amount to which the progressive jackpot can be incremented, which may prevent subsequent wagers from being applied to the current jackpot and decrease player engagement. Moreover, for progressive jackpots that frequently approach the maximum amount (e.g., jackpots associated with popular casino wagering games), the triggering amount may enable the increased turnover in jackpots, thereby increasing the frequency at which players may potentially win progressive jackpots and increase player engagement.

In some embodiments, the triggering amount is set at the maximum amount. That is, when the progressive jackpot reaches or exceeds the maximum amount, the game-logic circuitry 140 determines one or more winning players to award 212 the progressive jackpot. The maximum amount may be known to the players (e.g., presented via the display devices), or may be stored by the jackpot services server 102 for comparison to the current jackpot amount.

In other embodiments, the triggering amount is set between a predetermined lower amount and a predetermined upper amount (i.e., a range of values). That is, for each progressive jackpot, a respective triggering amount may be randomly determined within (and, in certain embodiments, including) the predetermined lower amount and the predetermined upper amount. The predetermined upper amount may be the maximum amount. The predetermined lower amount may be any suitable value (including zero). In the example embodiment, the predetermined lower amount is a non-zero amount greater than at least an initial value (e.g., zero or the reseeded value) of the progressive jackpot. That is, the triggering amount may be limited to a range of values such that the triggering amount may not immediately occur and award a relatively low-value progressive jackpot. In certain embodiments, the predetermined lower amount may be greater than an activation amount of the progressive jackpot. The activation amount is an amount greater than the initial value of the progressive jackpot at which jackpot awards are available for the progressive-winning outcome. That is, the progressive jackpot may be required to achieve a certain level of funding before a jackpot award for the progressive-winning outcome can be awarded.

By establishing a predetermined lower amount greater than the activation amount, the progressive jackpot is managed within at least two states: (i) a first state in which jackpot awards may be tied solely to the progressive-winning outcomes, and (ii) a second state in which jackpot awards may be awarded in response to the triggering amount in addition to or in place of the progressive-winning outcomes. That is, for the second state, the triggering amount may be used another available avenue for awarding the progressive jackpot (as shown in FIG. 5, where steps 208, 210 occur in parallel to step 214), or progressive-winning outcome may be replaced by the triggering amount as the sole avenue for awarding jackpot awards. In some embodiments, reaching the triggering amount may not automatically result in a jackpot award. For example, in response to the progressive jackpot being incremented to the triggering amount, the game-logic circuitry 140 may perform a random determination (e.g., using random number generation as described herein) that includes the possibility of no winning players. In such embodiments, a plurality of triggering amounts may be provided, and reaching the predetermined upper amount may cause the game-logic circuitry 140 to automatically identify one or more winning players.

The winning players identified in response to the triggering amount may be determined randomly and/or based on play of the casino wagering game. In one example, the game-logic circuitry 140 is configured to generate one or more random numbers that may be incorporated into a function to determine the winning players or compared to a list of numbers representing the players, where the winning players are associated with numbers matching the generated random numbers. In another example, the player that placed the wager that incremented the progressive jackpot to the triggering amount may be identified as the winning player.

Similar to the jackpot awards for the progressive-winning outcomes, the jackpot services server 102 may notify the gaming machines 10 and/or the accounting services system 106 of the winning players and the jackpot amount to be awarded to the winning players. The progressive jackpot may then be reseeded to an initial value and the method 200 may be repeated for the new progressive jackpot. If a player wished to conclude play of the casino wagering game, the player initiates a cashout process. More specifically, the game-logic circuitry 40 at the gaming machine 10 associated with the player receives 216 a cashout input that initiates a payout from the credit balance (including any jackpot awards the player may have been awarded). The payout may take the form of one or more physical items being provided to the player either having a monetary value (e.g., dollar bills and coins) or exchangeable for a monetary value (e.g., ticket). In certain embodiments, the payout may be provided digitally by releasing the credit balance to a digital wallet associated with the player.

The foregoing systems and methods provide improvements over existing systems and methods of managing jackpots by enabling dynamic progressive jackpots having a plurality of award avenues. That is, relative to systems only reliant upon progressive-winning outcomes, the foregoing systems and methods facilitate additional jackpot award opportunities that prevent the progressive jackpot from maintaining a maximum amount for a period of time, which may cause players to lose interest in the game. Relative to system that include "must-win" progressive jackpots, the foregoing systems and methods prevent jackpot awards from being award at below-value amounts that might decrease the appeal of the progressive jackpot while still providing an opportunity to win the progressive jackpot via the progressive-winning outcomes.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming system comprising:

a regulated gaming machine primarily dedicated to playing at least one casino wagering game, the gaming machine including one or more electronic input devices;

one or more display devices including a plurality of symbol-bearing mechanical reels; and game-logic circuitry configured to:

direct at least one of the one or more display devices to display a progressive jackpot;

detect, via at least one of the one or more electronic input devices, a physical item associated with a monetary value that establishes a credit balance;

increment the progressive jackpot in response to play of the casino wagering game;

direct at least one of the one or more display devices to display an outcome resulting from the play of the casino wagering game by physically spinning and stopping the plurality of symbol-bearing mechanical reels;

in response to the displayed outcome being a progressive-winning outcome and the progressive jackpot is currently below a predetermined lower amount, cause the one or more display devices to present an award for the progressive jackpot, wherein the predetermined lower amount is greater than an activation amount of the progressive jackpot;

in response to detecting the progressive jackpot is currently at or above the predetermined lower amount, set the progressive-winning outcome to inactive to unlink the award for the progressive jackpot from the progressive-winning outcome, wherein the award for the progressive jackpot is selectively presented irrespective to detection of the inactive progressive-winning outcome;

in response to the progressive jackpot being incremented to a triggering amount at or above the predetermined lower amount, cause the one or more display devices to present the award for the progressive jackpot; and receive, via at least one of the one or more electronic input devices, a cashout input that initiates a payout from the credit balance.

2. The gaming system of claim 1, wherein the triggering amount is a maximum amount to which the progressive jackpot can be incremented.

3. The gaming system of claim 1, wherein the triggering amount is a randomly selected amount between the predetermined lower amount and a predetermined upper amount.

4. The gaming system of claim 3, wherein the predetermined lower amount is a non-zero amount.

5. The gaming system of claim 4, wherein the progressive jackpot becomes an available award for the progressive-winning outcome in response to the progressive jackpot exceeding the activation amount.

6. The gaming system of claim 1, wherein the plurality of symbol-bearing mechanical reels defines a symbol array, the progressive-winning outcome being a predefined symbol or symbol combination in the symbol array populated by symbols of the plurality of symbol-bearing mechanical reels.

7. The gaming system of claim 1, wherein the game-logic circuitry is configured to increment the progressive jackpot in response to receipt of a wager that initiates the play of the casino wagering game.

8. The gaming system of claim 1, wherein the game-logic circuitry is configured to randomly determine, in response to the progressive jackpot being incremented to the triggering amount, whether a winning player is identified, and wherein the award for the progressive jackpot is provided to the identified winning player.

9. The gaming system of claim 1, wherein, in response to the progressive jackpot being incremented to the triggering amount, cause the display device to present the award for the progressive jackpot by activating and automatically presenting the progressive winning outcome.

10. A method for conducting at least one casino wagering game using a gaming system including a regulated gaming machine primarily dedicated to playing the at least one casino wagering game, one or more display devices including a plurality of symbol-bearing mechanical reels, and game-logic circuitry, the method comprising:

directing, by the game-logic circuitry, at least one of the one or more display devices to display a progressive jackpot;

detecting, via at least one of one or more electronic input devices of the regulated gaming machine, a physical item associated with a monetary value that establishes a credit balance;

incrementing, by the game-logic circuitry, the progressive jackpot in response to play of the casino wagering game;

directing, by the game-logic circuitry, at least one of the one or more display devices to display an outcome resulting from the play of the casino wagering game by physically spinning and stopping the plurality of symbol-bearing mechanical reels;

in response to the displayed outcome being a progressive-winning outcome and the progressive jackpot is currently below a predetermined lower amount, causing, by the game-logic circuitry, the one or more display devices to present an award for the progressive jackpot, wherein the predetermined lower amount is greater than an activation amount of the progressive jackpot;

in response to detecting the progressive jackpot is currently at or above the predetermined lower amount, setting, by the game-logic circuitry, the progressive-winning outcome to inactive to unlink the award for the progressive jackpot from the progressive-winning outcome, wherein the award for the progressive jackpot is selectively presented irrespective to detection of the inactive progressive-winning outcome;

in response to the progressive jackpot being incremented to a triggering amount at or above the predetermined lower amount, causing, by the game-logic circuitry, the one or more display devices to present the award for the progressive jackpot; and receiving, via at least one of the one or more electronic input devices, a cashout input that initiates a payout from the credit balance.

11. The method of claim 10, wherein the triggering amount is a maximum amount to which the progressive jackpot can be incremented.

12. The method of claim 10, wherein the triggering amount is a randomly selected amount between the predetermined lower amount and a predetermined upper amount.

13. The method of claim 12, wherein the predetermined lower amount is a non-zero amount.

14. The method of claim 13, wherein the progressive jackpot becomes an available award for the progressive-winning outcome in response to the progressive jackpot exceeding the activation amount.

15. The method of claim 10, wherein the plurality of symbol-bearing mechanical reels defines a symbol array, the progressive-winning outcome being a predefined symbol or symbol combination in the symbol array populated by symbols of the plurality of symbol-bearing mechanical reels.

16. The method of claim 10, wherein the game-logic circuitry increments the progressive jackpot in response to receipt of a wager that initiates the play of the casino wagering game.

17. A regulated gaming machine primarily dedicated to playing at least one casino wagering game, the gaming machine comprising:

one or more electronic input devices;

one or more display devices including a plurality of symbol-bearing mechanical reels; and game-logic circuitry configured to:

direct at least one of the one or more display devices to display a progressive jackpot;

detect, via at least one of the one or more electronic input devices, a physical item associated with a monetary value that establishes a credit balance;

increment the progressive jackpot in response to play of the casino wagering game;

direct at least one of the one or more display devices to display an outcome resulting from the play of the casino wagering game by physically spinning and stopping the plurality of symbol-bearing mechanical reels;

in response to the displayed outcome being a progressive-winning outcome and the progressive jackpot is currently below a predetermined lower amount, cause the one or more display devices to present an award for the progressive jackpot, wherein the predetermined lower amount is greater than an activation amount of the progressive jackpot;

in response to detecting the progressive jackpot is currently at or above the predetermined lower amount, set the progressive-winning outcome to inactive to unlink the award for the progressive jackpot from the progressive-winning outcome, wherein the award for the progressive jackpot is selectively presented irrespective to detection of the inactive progressive-winning outcome;

in response to the progressive jackpot being incremented to a triggering amount at or above the predetermined lower amount, cause the one or more display devices to present the award for the progressive jackpot; and receive, via at least one of the one or more electronic input devices, a cashout input that initiates a payout from the credit balance.

18. The regulated gaming machine of claim 17, wherein the triggering amount is a maximum amount to which the progressive jackpot can be incremented.

19. The regulated gaming machine of claim 17, wherein the triggering amount is a randomly selected amount between the predetermined lower amount and a predetermined upper amount.

20. The regulated gaming machine of claim 19, wherein the progressive jackpot becomes an available award for the progressive-winning outcome in response to the progressive jackpot exceeding the activation amount.

21. The regulated gaming machine of claim 17, wherein the plurality of symbol-bearing mechanical reels defines a symbol array, the progressive-winning outcome being a predefined symbol or symbol combination in the symbol array populated by symbols of the plurality of symbol-bearing mechanical reels.

22. The regulated gaming machine of claim 17, wherein the game-logic circuitry is configured to increment the progressive jackpot in response to receipt of a wager that initiates the play of the casino wagering game.

* * * * *